US005209281A

United States Patent [19]

Kraeutler

[11] Patent Number: 5,209,281

[45] Date of Patent: May 11, 1993

[54] ANTI-JAMMING SAFETY DEVICE FOR A CURTAIN-TYPE DOOR HAVING REINFORCING BARS

[75] Inventor: Bernard Kraeutler, La Villette, France

[73] Assignee: Nergeco (société anonyme), Dunieres, France

[21] Appl. No.: 836,209

[22] Filed: Feb. 13, 1992

[30] Foreign Application Priority Data

Feb. 27, 1991 [FR] France ..... 91 02346

[51] Int. Cl.[5] ..... E06B 3/94

[52] U.S. Cl. ..... 160/84.1; 160/264

[58] Field of Search ..... 160/84.1, 133, 270, 160/271, 272, 273.1, 207, 32, 36, 264

[56] References Cited

U.S. PATENT DOCUMENTS 4,397,347 8/1983 Brahant ..... 160/84.1 X

FOREIGN PATENT DOCUMENTS 315450 5/1974 Austria .

1709192 7/1970 Fed. Rep. of Germany .

2206789 8/1973 Fed. Rep. of Germany .

2369408 5/1978 France .

*Primary Examiner*—David M. Purol

*Attorney, Agent, or Firm*—Sughrue, Mion, Zinn, Macpeak & Seas

[57] ABSTRACT

A vertically-raisable door for industrial use includes a curtain 4 reinforced by bars 5 whose ends are guided in slideways, each comprising a web 7 and two guide walls 8, 9. The width of each slideway is reduced at its bottom end by a filler component 20 received inside the slideway against the web and a guide wall. The filler component has a clearance surface 23 facing the bay, and a ramp comprising an upper guide surface 21 and a placement surface 24 facing the opposite guide wall. The clearance surface slopes from the bottom towards the web of the slideway at an angle lying in the range about 1° to about 10°, and preferably in the range 2° to 5°, such that the horizontal distance between the clearance surfaces of the two facing slideways increases going upwards.

8 Claims, 3 Drawing Sheets

ANTI-JAMMING SAFETY DEVICE FOR A CURTAIN-TYPE DOOR HAVING REINFORCING BARS

BACKGROUND OF THE INVENTION

The present invention relates to vertically-raisable doors for industrial use to insulate workshops, stores, etc. from drafts and to protect their temperature and sound-level environments relative to other workshops, stores, etc. or relative to the outside, and it relates more particularly to "curtain-type" doors whose main component for closing a door-bay is a curtain which may be flexible and which is raised to be folded up in the top portion of the door, or which may be constituted by rigid panels which rise above the door bay to open the door. The edges of such a curtain, or at least the ends of reinforcing bars that may also constitute hinges of such a curtain are guided in lateral slideways received in or formed by the vertical lateral uprights of a door-frame which also includes a top cross-member, thereby presenting an assembly of adequate mechanical strength. The top cross-member may house mechanical components such as a motor, an end-of-stroke contact, a wind-up shaft, electrical apparatus, etc.

During the up and down movements of the door, the slideways must be relatively wide, at least over a certain height thereof, in order to allow the curtain to move without restriction. However, when the door is in its closed or down position, the curtain must remain as stationary as possible in a vertical plane, preferably against one of the edges of each slideway, namely the edge against which wind pressure urges it most often, in order to eliminate both disagreeable noise and vibration that may damage the equipment. That is why the lateral slideways for the edges of such curtains and for the ends of their reinforcing bars have a bottom portion of narrower section that matches the thickness of the curtain or the thickness of the reinforcing bars.

Since it is not desirable, economically speaking, to make slideways of tapering width, this means that filler components are placed in the bottom portions of such slideways to reduce the available inside width thereof progressively. Such components may be made of welded sheet metal, of molded plastic, or in the form of a solid block made of wood, metal, plastic, etc. It often turns out that the remedy is worse than the original problem. In combatting undesirable vibration and noise, various causes such as gusts of wind, or inaccuracy in assembly or in manufacture of the door structure can lead to jamming such that when the curtain is raised it is torn and destroyed.

An object of the invention is to provide a device that enables the curtain to be properly positioned when down, while avoiding jamming.

SUMMARY OF THE INVENTION

The present invention provides a vertically-raisable goods-handling door of the curtain type for industrial use and including a curtain for closing a door-bay, the curtain being flexible or made up of rigid panels that are hinged to one another, and being reinforced by reinforcing bars whose ends are guided in slideways each comprising a web and two guide walls, namely a first guide wall against which the curtain is pressed when in the down position, and a second guide wall, said slideways being constituted by or formed in lateral uprights forming parts of a door-frame surrounding the door-bay, the width of each slideway being reduced at its bottom end by means of a filler component received inside the slideway against the web of the slideway and against said second guide wall, said component having a clearance surface facing the door-bay, and a guide ramp comprising an upper guide surface and a placement surface facing said first guide wall of the slideway and sloping down towards said first guide wall to cooperate with said first guide wall to delimit a placement volume that tapers downwards, wherein the clearance surface slopes from the bottom towards the web of the slideway at an angle lying in the range about 1° to about 10°, and preferably in the range 2° to 5°, such that the horizontal distance between the clearance surfaces of the two slideways in the two facing vertical lateral uprights increases going upwards.

It will thus be understood that if for any reason a reinforcing bar takes up a skew position with one end wedged against a clearance surface having such a slope, a lifting force will immediately have the effect of initiating unjamming.

In addition, to improve this tendency to unjam, it is advantageous for the clearance surface to slope horizontally from its edge in contact with the second guide wall of the slideway towards the web of the slideway. In addition, the placement surface of each filler component is deflected horizontally going from the web of the slideway towards the second guide wall such that said placement volume flares horizontally away from the web of the slideway.

Advantageously, the filler component houses a cell for monitoring the space between the slideways for the purpose of interrupting the lowering of the curtain and/or causing it to be raised again in the event of there being an obstacle in the plane in which the curtain is lowered, a hole being formed for this purpose in said clearance surface.

BRIEF DESCRIPTION OF THE DRAWINGS

Embodiments of the invention are described by way of example with reference to the accompanying drawings, in which.

DETAILED DESCRIPTION OF THE PREFERRED EMBODIMENT

Figure 1:
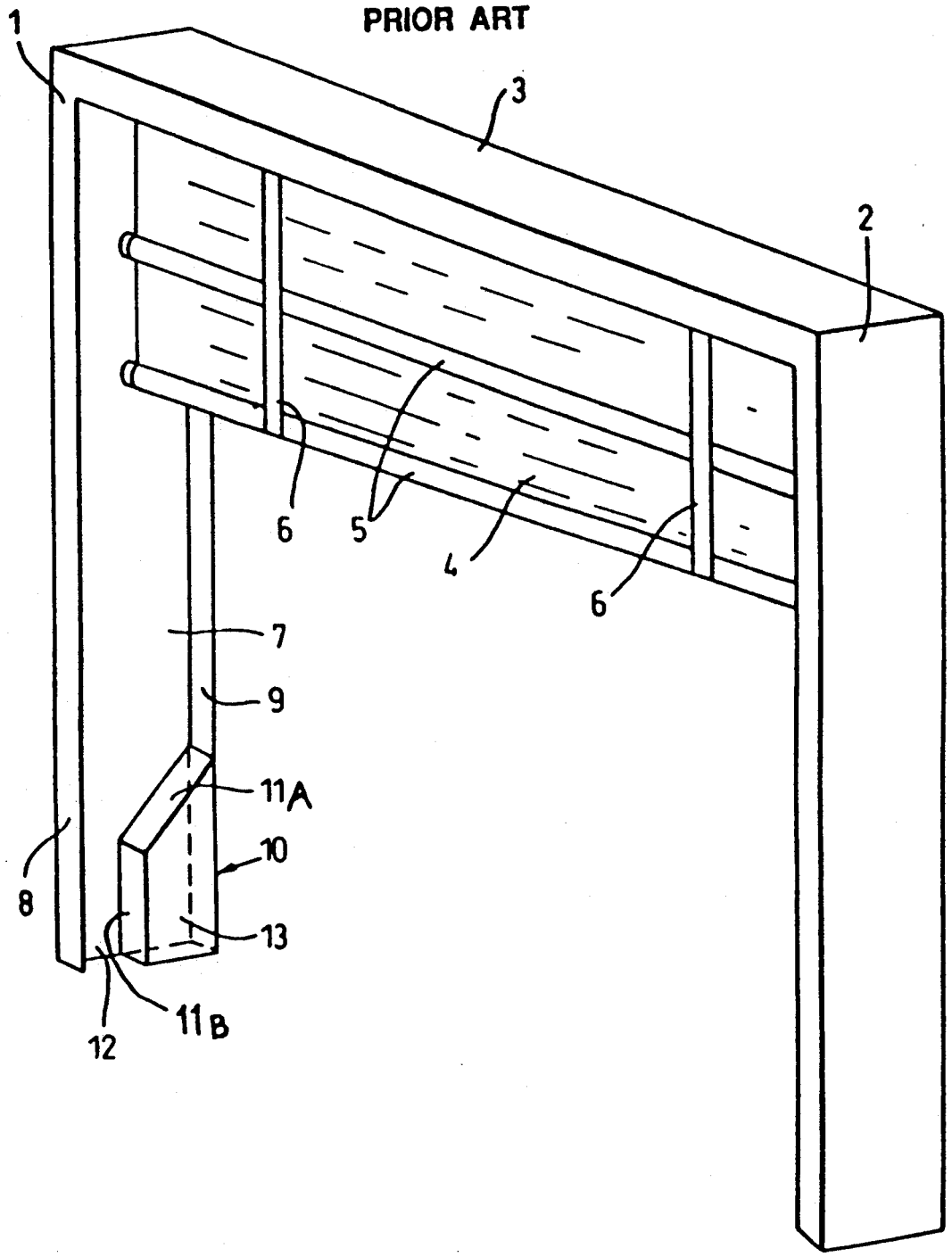
FIG.1 PRIOR ART
FIG. 1 is a perspective view of a prior art door of a type to which the present invention may be applied.

The lefthand half of FIG. 1 shows details of a door to which the invention can be applied. The door comprises two lateral uprights 1 and 2 that are interconnected at their top ends by cross-member 3. The assembly constitutes a door frame that can be placed around a door-bay formed through a wall. The bay may be closed by a curtain 4 which is reinforced by reinforcing bars 5. One end of the curtain is fixed to the top of the door inside the cross-member 3. The curtain is reinforced by reinforcing bars 5 whose ends slide in slideways formed in the lateral uprights. To raise or lower the curtain, straps 6 are fixed to the bottom bar and may be wound onto a shaft which is disposed inside the top cross-member together with the mechanical and electrical means for actuation and control purposes.

The slideways shown in this figure are formed directly by the uprights: each slideway has a web 7, a first guide wall 8, and a second guide wall 9. The free edges of the guide walls may include one or more folds towards the inside of the slideway to stiffen it or to improve sliding by eliminating sharp edges. Since these folds form no part of the present invention, they are omitted from the figure in order to clarify the description.

The slideway must be relatively wide, at least at the top portion thereof and down to a certain height above its bottom end to leave room when the curtain is raised for its folded edges and the ends of its reinforcing bars to be collected together. However, when the curtain is lowered, it must be held as securely as possible to prevent flapping. The slideway is therefore made narrower at its bottom end corresponding to the bottom two or three bars when the curtain is down. To facilitate manufacture and to avoid weakening the uprights, this narrowing is achieved by placing a filler component 10 inside the slideway, the filler component comprising a guide ramp having a guide surface 11A and a placement surface 11B facing the first guide wall 8 of the slideway, to co-operate therewith to define a placement volume 12 that tapers downwards for receiving the curtain and its bottom bar(s) with little clearance. When the curtain is down, its bottom portion is thus urged towards the first guide wall of the slideway. The guide ramp should therefore be sited appropriately as a function of conditions, and in particular the prevailing wind which causes the curtain to be pressed one way more than the other. In FIG. 1, the guide ramp forms a fixed or constant angle between the guide surface and the placement surface. However it could equally well be curved or polygonal.

The surfaces 11A, 11B may be constituted by a strip of welded sheet metal. If a force that is unexpected, accidental, or due to a sudden intake of air or gust, etc., should cause the bottom bar to bend so that its end becomes engaged beneath the metal strip, then next time the curtain is raised, the bar will be caught and the curtain may be destroyed. If a solid surface 13 (referred to below as a clearance surface) is applied to the guide ramp to cover it on the outside, the same risk nevertheless remains. Under the effect of an abnormal force the bottom bar can escape from the placement volume 12 and can jam with its end wedged against the surface 13 so that on the next occasion the curtain is raised, it is torn.

An object of the invention is to eliminate this danger. The invention is shown in detail in FIG. 2 which shows the bottom of a slideway on a larger scale, including its web 7, its first guide wall 8, and its second guide wall 9. The filler component 20 of the invention is put in the place of the conventional component 10 shown in FIG. 1.

According to the invention, the filler component 20 includes a clearance surface 23 which slopes upwards towards the web of the slideway. Its angle of inclination, marked A to the right of FIG. 2, advantageously lies in the range 1° to 10°, and preferably in the range 2° to 4°, except for very large doors where the angle may be greater. Too small an angle would be ineffective, while too great an angle would reduce the width L of the top of the ramp excessively.

Figure 2:
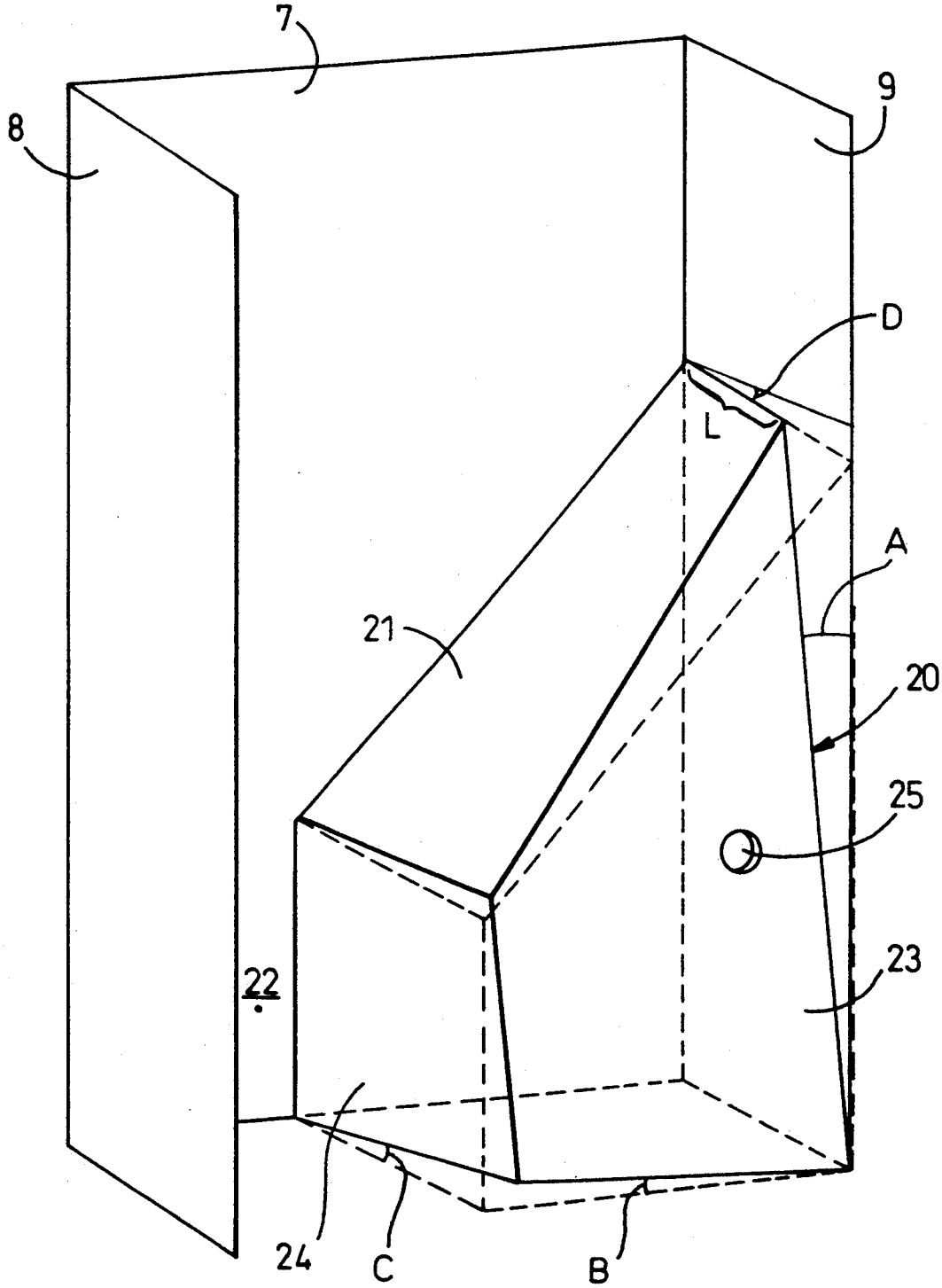
FIG. 2 is a view on a larger scale of a portion of the FIG. 1 door modified in accordance with the present invention.

The clearance surface 23 advantageously also slopes horizontally from the edge of the component which is in contact with the second guide wall 9 towards the web of the slideway at an analogous angle B which appears at the bottom of FIG. 2. This slope is to make it possible for wind pushing the curtain towards the first wall 8 to perform unjamming. It is recalled that the placement volume 22 is provided along the wall of the slideway against which the wind or the differential pressure across the door pushes the curtain most often. The clearance surface may be plane or it may be curved, i.e. its angles of slope may vary.

Furthermore, according to another advantageous characteristic of the invention, the placement surface 24 may be deflected horizontally through an angle C from the web of the slideway towards the second guide wall such that the placement volume 22 flares horizontally away from the web of the slideway. It is also advantageous for top guide surface 21 to slope downwards through an angle D that may be about the same size.

Naturally, the guide surface 21 and the placement surface 24 may form a dihedral angle as shown in FIG. 2, but they may also run into each other via a polygonal or a rounded outline.

Under such conditions, the end of a reinforcing bar cannot get under the guide surface 21 since the volume delimited beneath said surface is closed by the clearance surface 23. Similarly, if the end of a bar should wedge itself against the clearance surface 23, the traction force exerted to raise the curtain cannot increase the jamming, and on the contrary, unjamming takes place and the bar is cleared. These simple changes in implementation provide safety by eliminating a cause of serious breakdown and by contributing to door reliability.

According to an advantageous characteristic of the invention, the set of surfaces 21, 23, and 24 are made as a single piece, preferably as a molding of plastic, thereby making it simple and reliable to install and easy to store by interfitting such components, with interfitting being made possible by the flared shape of the guide ramp.

The filler component of the present invention may be used for housing a safety device such as a cell for emitting or receiving appropriate radiation (infrared, laser, etc.), one housing an emitter, the other a receiver. For this purpose a hole 25 is provided in the clearance surface 23.

Figure 3:
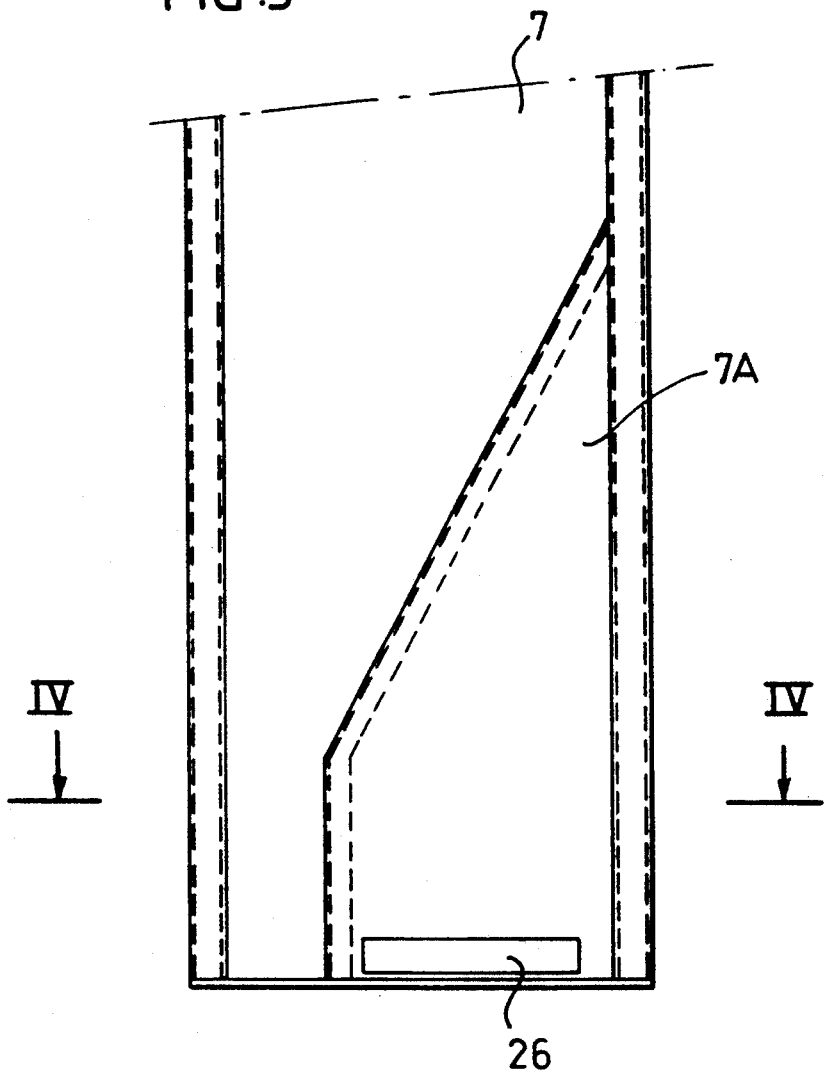
FIG. 3 is an elevation view of a variant.
Figure 4:
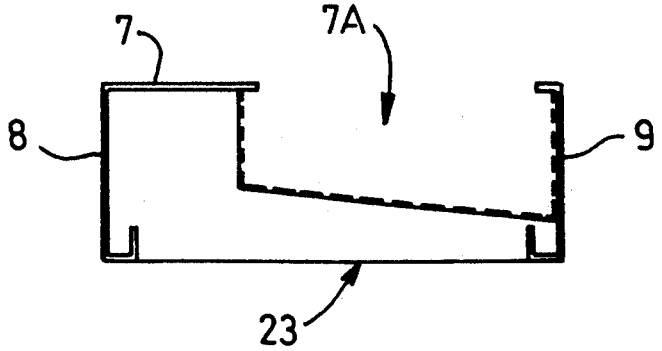
FIG. 4 is a section view on a horizontal plane on line IV—IV of FIG. 3.

FIGS. 3 and 4 show a variant application. Doors of this type may be used in warehouses for food or pharmaceuticals. Under such circumstances, it is necessary to eliminate so far as possible any volumes which are inaccessible for cleaning. Otherwise dirt may accumulate and bacteria can develop. The guide ramp of FIG. 2 delimits a closed volume at the bottom of the upright. This volume is not accessible to cleaning by water jet. In an alternate of the invention, as shown in FIGS. 3 and 4, the web of the upright hidden by the guide ramp is cut away so as to leave an opening 7A having the same profile as the guide ramp. The inside of this cavity can therefore be cleaned by means of a jet, thereby ensuring clean conditions that prevent bacteria developing.

This feature can be further improved by providing a window 26 at the bottom of the clearance surface 23 to facilitate evacuation of cleaning water and to avoid water stagnating.

I claim:

1. A vertically-raisable door of the curtain type for industrial use and including a curtain for closing a door-bay, and being reinforced by bars whose ends are guided in slideways, each slideway comprising a web, a first guide wall against which the curtain is pressed when in a down position, and a second guide wall, said slideways forming lateral uprights of a door-frame surrounding the door-bay, the width of each slideway being reduced at its bottom end by means of a filler component received inside the slideway against the web of the slideway and against said second guide wall, said component having a clearance surface (23) facing the door-bay, and a guide ramp comprising an upper guide surface (21) and a placement surface (24) facing said first guide wall of the slideway and sloping down towards said first guide wall to co-operate with said first guide wall to delimit a placement volume that tapers downwards, wherein the clearance surface slopes from the bottom towards the web of the slideway at an angle (A) lying in a range from about 1° to about 10° such that the horizontal distance between the clearance surfaces of the two slideways in the two facing vertical lateral uprights increases going upwards.

2. A door according to claim 1, in which the clearance surface also slopes horizontally from its edge in contact with the second guide wall of the slideway towards the web of the slideway at an angle (B) lying in a range from about 1° to about 10°.

3. A door according to claim 1, in which the placement surface of each filler component is deflected horizontally going from the web of the slideway towards the second guide wall such that said placement volume flares horizontally away from the web of the slideway at an angle (C) lying in a range from about 1° to about 10°.

4. A door according to claim 1, in which a top of the guide surface slopes horizontally downwards through an angle (D) lying in a range from about 1° to about 10°.

5. A door according to claim 1, in which an orifice (25) is formed through the clearance surface to pass radiation of a presence detection cell.

6. A door according to claim 1, in which a portion of the web of the upright as delimited by the guide ramp is cut out to form an opening having the same profile as the guide ramp.

7. A door according to claim 6, in which a window (26) is provided in a bottom portion of the clearance surface to facilitate cleaning.

8. A door according to claim 1, in which the filler component is made of molded plastic.

* * * * *